United States Patent [19]

Cyrot

[11] Patent Number: 4,536,728

[45] Date of Patent: Aug. 20, 1985

[54] VALVE SOLENOID WINDINGS

[75] Inventor: Luc P. Cyrot, Mission Viejo, Calif.

[73] Assignee: International Telephone & Telegraph Corp., New York, N.Y.

[21] Appl. No.: 538,236

[22] Filed: Oct. 3, 1983

[51] Int. Cl.[3] ..... H01H 9/00

[52] U.S. Cl. ..... 335/182; 335/266; 335/268

[58] Field of Search ..... 335/250, 266, 268, 282, 335/180, 182, 177

[56] References Cited

U.S. PATENT DOCUMENTS

| | | | |
|---|---|---|---|
| 1,260,648 | 3/1918 | Conrad | 335/182 X |
| 2,040,389 | 5/1936 | Lamb | 335/180 X |
| 2,278,971 | 4/1942 | Boehne | 335/182 X |
| 3,256,404 | 6/1966 | Newman et al. | 335/180 X |
| 3,708,723 | 1/1973 | Shand et al. | 335/182 X |

*Primary Examiner*—George Harris

*Attorney, Agent, or Firm*—T. L. Peterson; J. S. Christopher

[57] ABSTRACT

A solenoid having one or more windings, a plurality of alternate windings of which are connected in electromagnetic field bucking relationship. An alternative construction utilizes layers of bifilar windings. A first winding of each bifilar winding pair in a first layer is adapted to procduce a field to buck the field of a second winding in the same bifilar winding pair.

4 Claims, 6 Drawing Figures

VALVE SOLENOID WINDINGS

BACKGROUND OF THE INVENTION

This invention relates to a valve solenoid or the like, and more particularly to a solenoid winding of a construction to permit rapid plunger operation through rapid changes in current amplitude and/or direction.

PRIOR ART STATEMENT

The construction of an electrical coil for a direct-current solenoid for a valve is usually subjected to three main requirements. Firstly, the coil must create a minimum operating force. This is dictated by the product of the current magnitude and the number of coil turns. Secondly, electrical power consumption for a given voltage should not exceed a certain limit. This then dictates the direct-current resistance of the coil. Thirdly, the temperature of the coil must not exceed a certain temperature. This in itself imposes a limit on the wire size or current density and the coil dimensions for proper heat transfer. Within these limits a variety of coils may be constructed.

In the solenoid which is required to operate in a very short period of time (i.e., within less than 2 milliseconds with a 5 pound force coil assembly), a fourth limitation is introduced. The inductance of the coil cannot exceed a certain limit. Otherwise, the current rise and fall time in the coil is excessive for rapid operation. Unfortunately, in a normal coil the previous three conditions—wire size, direct-current resistance and number of turns—dictate the inductance. This last condition often cannot be met. A common solution is to add a bulky direct-current resistor in series with the coil to limit the power consumption.

One prior art solution to this problem has been to use a coil whereby after winding a given number of turns the direction of the winding is reversed. The net result is that the direct-current resistance can be selected and adjusted independently of the number of active turns and the resulting inductance. Such a coil can meet the speed and force requirements and still cope independently with the power drain and heat dissipation condition.

A search was made. The following patents were cited in the search.

| Inventor(s) | U.S. Pat. No. |
|---|---|
| L. A. Trofimov | 1,810,306 |
| A. H. Lamb | 2,040,389 |
| E. D. Lilja | 2,268,882 |
| A. L. Blaha et al. | 3,075,059 |
| R. S. Winship | 3,134,867 |
| C. I. Clausing | 3,215,799 |
| T. A. O. Gross | 3,806,798 |
| Albert Franz | 3,975,721 |

None of the above-listed patents appear to be material except Lamb, Lilja and Winship.

Lamb discloses a reverse wound conductor 7 in FIG. 1 thereof.

Lilja appears to disclose bucking layers $PW_2$ and $CW_2$. See page 2, column 2, lines 26–33.

Winship discloses bifilar windings 38 and 40 in FIGS. 1 and 3 which are disposed in one layer only.

SUMMARY OF THE INVENTION

In accordance with the solenoid of the present invention, a high speed of response is achieved by the employment of a series of primary and bucking coils in the same or alternate layers.

In accordance with another feature of the present invention, a wound coil is provided wherein a top layer of wire is wound in a reverse direction which will effectively cancel an equivalent layer of wire underneath the top layer and leave a reduced number of active coil windings.

The top layer can include several layers of alternate winding directions in which each new layer cancels out the previous one.

The top or underneath layer cap also include a bifilar winding whereupon an electromagnetic field of each wire will cancel an electromagnetic field of each adjacent wire in each layer. Basically, the additional length of wire beyond the active turns is folded in a loop and the loop is wound in any direction.

BRIEF DESCRIPTION OF THE DRAWINGS

In the accompanying drawings which illustrate exemplary embodiments of the present invention.

DESCRIPTION OF THE PREFERRED EMBODIMENT

Figure 1:
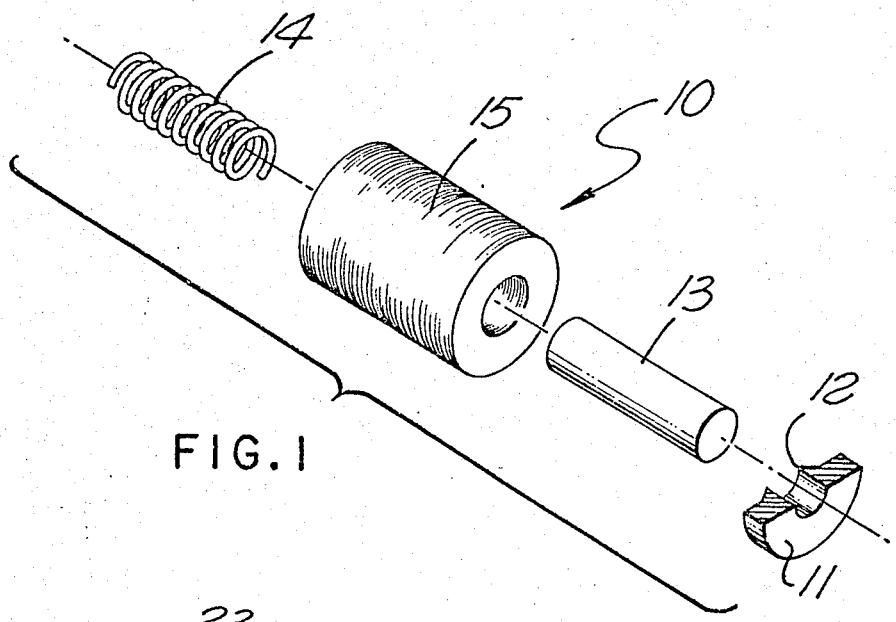
FIG. 1 is an exploded perspective view of a portion of a solenoid valve.

A solenoid valve is shown at 10 in FIG. 1 including a partition 11 forming a valve seat 12 against which an electromagnetic plunger 13 is forced by a compression spring 14. Valve 10 is normally closed when plunger 13 engages seat 12 and is opened by the electromagnetic force of attraction between a solenoid winding 15 constructed in accordance with the present invention and plunger 13.

Figure 2:
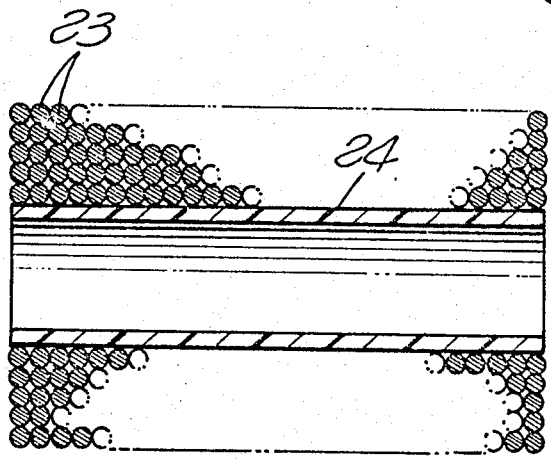
FIG. 2 is a transverse sectional view of a plurality of layers of solenoid windings on a bobbin.

In FIG. 2, turns 23 are wound upon a bobbin 24.

The turns of winding 15 of FIG. 1 may have a construction as shown in FIG. 2.

Figure 3:
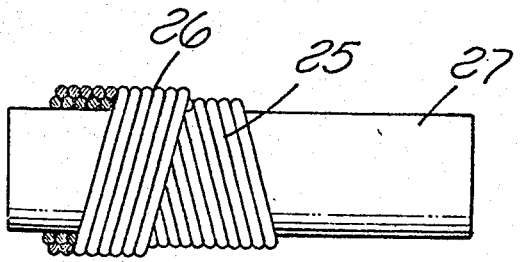
FIG. 3 is a top plan view of two different layers of solenoid windings on a single bobbin.

In FIG. 3, a lower layer 25 is wound below an upper layer 26 on a bobbin 27.

Figure 4:
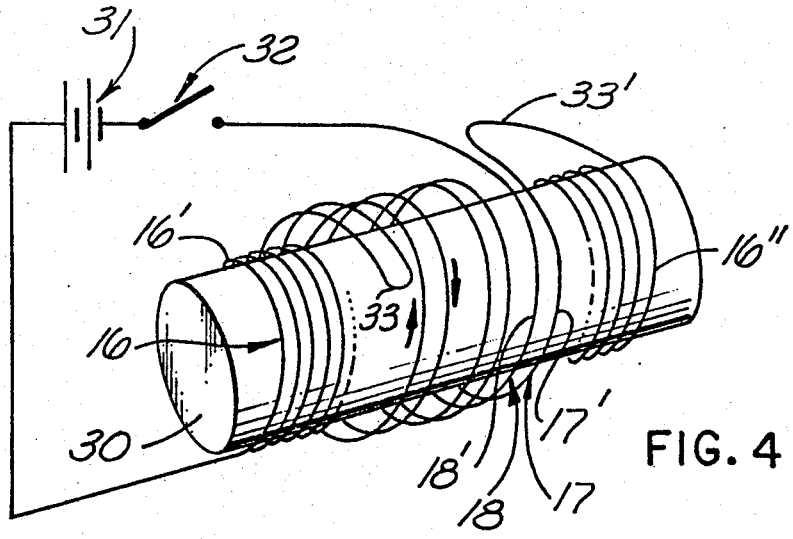
FIG. 4 is a perspective view of a plurality of solenoid windings on a bobbin.

In FIG. 4, coils 16, 17 and 18 are wound on a bobbin 30 and connected to a source of potential 31 and a switch 32. Coil 16 may form a lower layer and coils 17 and 18 may form an upper layer or vice versa. Coil 17 has the same number of turns as coil 18, but fewer turns than coil 16. If desired, coils 17 and 18 may be bifilar within the same layer. Note in FIG. 4 that a loop 33 connects the ends of coils 17 and 18. Coil 16 is continuous (not shown) from a first end turn 16' to a second end turn 16''. End turn 16'' is connected to end turn 17'' via loop 33'. End turn 18'' is connected to switch 32.

Figure 5:
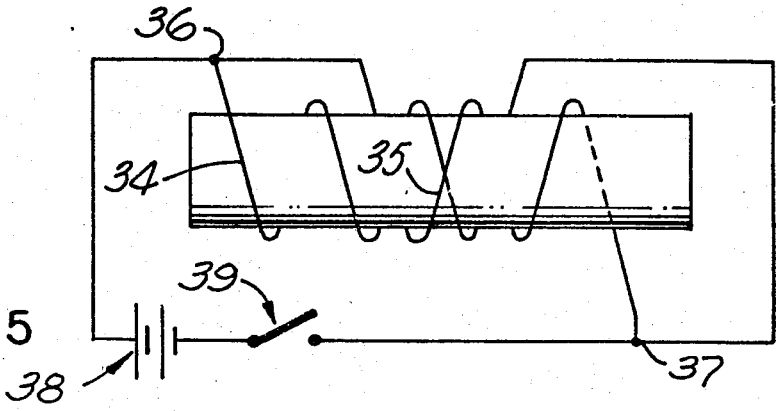
FIG. 5 is a side elevational view of another pair of solenoid windings on a bobbin.

In FIG. 5, coils 34 and 35 are connected at junctions 36 and 37 between which a source of potential 38 and switch 39 are connected. The assembly of FIG. 5 is constructed in accordance with the present invention, however coils 34 and 35 are not bifilar. Either one of coils 34 and 35 may include the top layer while the other includes the lower layer. Coil 34 is longer than coil 35.

Figure 6:
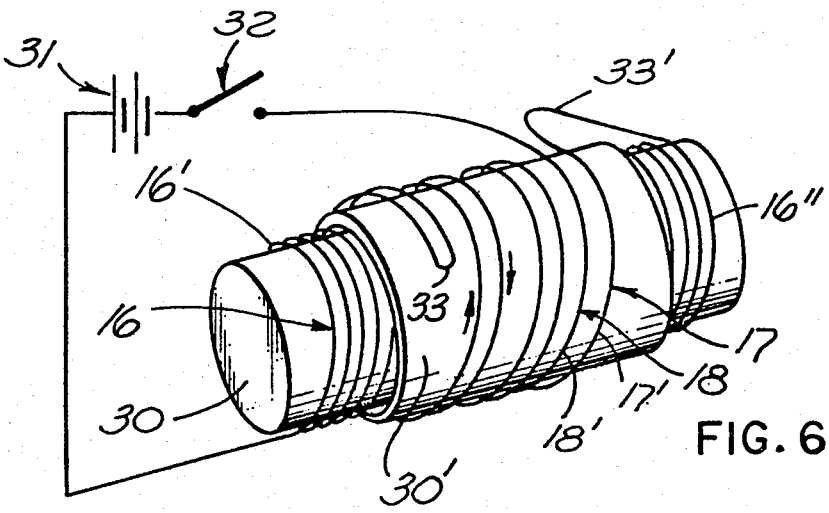
FIG. 6 is a perspective view of a pair of solenoid windings wound about an outer hollow bobbin concentric about an inner solenoid wound bobbin.

FIG. 6 is identical to FIG. 4 except for the addition of a hollow bobbin 30'.

What is claimed is:

1. A solenoid comprising:

a first winding in an inner first layer;

a second winding in an outer second layer partially surrounding said first winding in said inner first layer;

a third winding in one of said first and second layers wherein said third winding having an equal number of turns as said second winding and a fewer number of turns than said first winding, at least one of said second winding and said third winding being wound reverse of said first winding for effectively cancelling an equivalent layer of said first winding and for reducing the number of active coils of said first winding, said second winding and said third winding being joined by a bifilar winding; and means actuable to energize all three of said windings in a manner to cause a magnetic field produced by one of said first and second and third windings to cancel at least a portion of a magnetic field produced by another of said first and second and third windings and wherein said bifilar winding being comprised of a wound length of wire folded in a loop beyond said active turns of said first winding wherein said magnetic field produced by each wire of said second and third windings will cancel said magnetic field produced by each adjacent wire of each of said first and second layers, each of said first winding and said second winding and said third winding being electrically connected in series.

2. A solenoid comprising:

a first winding and a second winding in an inner layer and an outer layer, respectively, said second winding being wrapped about said first winding, each of said first and said second windings being of equal cross section; and means to cause a flow of a first electric current and a second electric current simultaneously in said first and said second windings, respectively, in directions and of magnitudes such that a magnetic field produced by said first winding is only partially cancelled by a magnetic field produced by said second winding effectively reducing the number of active coils of said first winding, said means being a source of potential and a switch connected in series between a first junction node of said first and second windings and a second junction node of said first and said second windings, said first and said second windings being electrically connected in parallel with said first winding being longer than said second winding.

3. A solenoid comprising:

a cylindrical-shaped bobbin;

a first winding in a first layer wrapped about said bobbin over a predetermined length thereof from a forward end to a rearward end thereof, the rearward end of said first winding being connected via a first loop of wire to a first end of a second winding in a second layer and wrapped about said bobbin;

a third winding located in said second layer and wrapped on said bobbin, said third winding having a first end and a second end wherein said first end of said third winding being connected via a second loop of wire to a second end of said second winding, said third winding having an equal number of turns as said second winding and a fewer number of turns than said first winding, at least one of said second winding and said third winding being wound reverse of said first winding for effectively cancelling an equivalent layer of said first winding and for reducing the number of active coils of said first winding, said second loop of wire joining said second winding and said third winding being a bifilar winding; and a source of potential and a switch connected in series between said forward end of said first winding and a second end of said third winding, said source of potential causing a magnetic field produced by one of said first and second and third windings to cancel at least a portion of a magnetic field produced by another of said first and second and third windings and wherein said bifilar winding being comprised of a wound length of wire folded into said second loop of wire beyond said active turns of said first winding wherein said magnetic field produced by each wire of said second and third windings oppose said magnetic field produced by each adjacent wire of each of said first and second layers, each of said first winding and said second winding and said third winding being electrically connected in series with said first winding wound continuous along said predetermined length of said bobbin.

4. A solenoid comprising:

a first cylindrical-shaped bobbin;

a first winding in a first layer wrapped about said first bobbin over a predetermined length thereof from a forward end to a rearward end thereof, said rearward end of said first winding being connected via a first loop of wire to a first end of a second winding in a second layer, said second winding wrapped about a second bobbin, said second bobbin being an outer hollow bobbin concentric about said first bobbin;

a third winding located in said second layer and wrapped about said second bobbin, said third winding having a first end and a second end wherein said first end of said third winding being connected via a second loop of wire to a second end of said second winding; said third winding having an equal number of turns as said second winding and a fewer number of turns than said first winding at least one of said second winding and said third winding being wound reverse of said first winding for effectively cancelling an equivalent layer of said first winding and for reducing the number of active coils of said first winding, said second loop of wire joining said second winding and said third winding being a bifilar winding; and a source of potential and a switch connected in series between said forward end of said first winding and a second end of said third winding, said source of potential causing a magnetic field produced by one of said first and second third windings to cancel at least a portion of a magnetic field produced by another of said first and second and third windings and wherein said bifilar winding being comprised of a wound length of wire folded into said second loop of wire beyond said active turns of said first winding wherein said magnetic field produced by each wire of said second and third windings oppose said magnetic field produced by each adjacent wire of each of said first and second layers, each of said first winding and said second winding and said third winding being electrically connected in series with said first winding wound continuous along said predetermined length of said first bobbin.

* * * * *